United States Patent [19]

Scott et al.

[11] 4,100,877

[45] Jul. 18, 1978

[54] PROTECTIVE CONTROL SYSTEM FOR WATER-JET PROPULSION SYSTEMS

[75] Inventors: John H. Scott, Issaquah; Walter R. Weist, Bellevue, both of Wash.

[73] Assignee: The Boeing Company, Seattle, Wash.

[21] Appl. No.: 727,023

[22] Filed: Sep. 27, 1976

[51] Int. Cl.[2] ..... B63H 11/08

[52] U.S. Cl. ..... 115/11; 60/39.28 R; 60/221; 60/233; 114/275; 318/588

[58] Field of Search ..... 60/39.27, 39.28 R, 39.29, 60/221, 222, 233, DIG. 2; 114/275, 274, 288–290; 115/11, 12 R, 14, 16; 318/588; 340/27 SS

[56] References Cited

U.S. PATENT DOCUMENTS

| | | | |
|---|---|---|---|
| 3,175,526 | 3/1965 | Johnson, Jr. et al. | 114/275 |
| 3,314,391 | 4/1967 | Duport | 115/16 |
| 3,852,958 | 12/1974 | Adams et al. | 60/39.28 R |
| 3,867,717 | 2/1975 | Moehring et al. | 340/27 SS |
| 3,910,216 | 10/1975 | Shultz | 114/275 |

*Primary Examiner*—Stephen G. Kunin
*Attorney, Agent, or Firm*—Thomas H. Murray

[57] ABSTRACT

A protective system is provided for water-jet propulsion systems in which water entering through an intake port is discharged in a jet by a pump. Unloading and overspeed of the pump prime mover may occur if the intake comes out of the water and this is prevented by a system which senses the water pressure in the pump inlet and responds to the pressure and the rate of change of pressure to prevent overspeed of the prime mover by setting it to idling speed. When the pressure and rate of change indicate that the intake is again submerged, the prime mover is reset to normal operating control.

7 Claims, 4 Drawing Figures

PROTECTIVE CONTROL SYSTEM FOR WATER-JET PROPULSION SYSTEMS

BACKGROUND OF THE INVENTION

The present invention relates to water-jet propulsion systems for watercraft, and more particularly to a protective control system for preventing overspeeding and undesired shutdown of the jet pump prime mover in such propulsion systems due to unloading of the prime mover.

The invention is particularly suitable for use on hydrofoil watercraft in which the hull is supported on struts which have foil systems at their lower ends. When such a craft is driven at a sufficiently high speed, the submerged foils develop lift and support the hull of the craft above the water surface. Such craft can be operated at relatively high speeds as compared to conventional watercraft, and can be designed to be capable of operation in rough water. They are particularly desirable for operation under these conditions since the hull is supported above the surface and a relatively smooth ride is obtained even though the sea may be quite rough.

Hydrofoil craft may, of course, be propelled by any type of propulsion system. Water-jet propulsion systems, however, are very desirable for these craft. In such a system, a water intake is provided in or on one of the struts and takes in water under ram pressure due to the forward movement of the craft through the water. Water entering through the intake is directed to a pump and is accelerated by the pump and discharged rearwardly in a high-velocity jet, resulting in a forwardly directed reaction force which propels the craft. A prime mover of any suitable type is used to drive the pump and provide the desired propulsive force. A relatively simple system is thus provided which is capable of attaining the desired high speed.

As previously mentioned, hydrofoil craft are capable of operating in rough water and this involves a problem in the use of a water-jet propulsion system. When relatively high waves are encountered, it is possible for the water intake to occasionally broach, or break through the water surface. When this occurs, air is drawn into the pump system, sharply reducing the load or causing large fluctuations in the load on the prime mover. This results in essentially unloading the prime mover and causing overspeed so that the usual protective devices operate and shut down the prime mover. This immediately reduces the propulsive force to zero and reduces the speed of the craft sufficiently to cause it to drop to the surface of the water and become hullborne. Several minutes are usually required for the prime mover to be restarted and for the craft to accelerate to high enough speed to again become foilborne. This is undesirable because of discomfort to the passengers due to the sudden change to hullborne conditions, especially in rough water when this condition is most likely to occur, and overspeeding of the pump prime mover due to unloading may involve some possibility of damage to the prime mover.

SUMMARY OF THE INVENTION

The present invention provides a protective control system which prevents overspeeding and shutdown of the prime mover of a water-jet propulsion system as discussed above. This is done by anticipating the occurrence of the conditions which would cause unloading and overspeeding, and quickly setting the prime mover to idling speed. After conditions have returned to normal, the prime mover is promptly reset to normal operation.

More specifically, the water pressure in the pump inlet of the water-jet system is sensed and signals are generated representing the water pressure and the rate of change of the water pressure. These signals are compared to preset reference levels and when both the pressure and the rate of change fall below the respective reference levels and remain below them for a preset time interval, the system immediately sets the prime mover to idling speed. The pressure and rate signals are also compared to a second set of reference levels and when these levels are exceeded, in a manner which indicates that the water conditions in the inlet are returning to normal, the prime mover is reset to normal operating conditions, that is, it is returned to the normal throttle control. In this way, unloading and overspeeding of the prime mover are prevented and it is not completely shut down because of a brief absense of water entering the intake of the propulsion system.

BRIEF DESCRIPTION OF THE DRAWINGS

The invention will be more fully understood from the following detailed description, taken in connection with the accompanying drawings, in which.

DESCRIPTION OF THE PREFERRED EMBODIMENT

Figure 1:
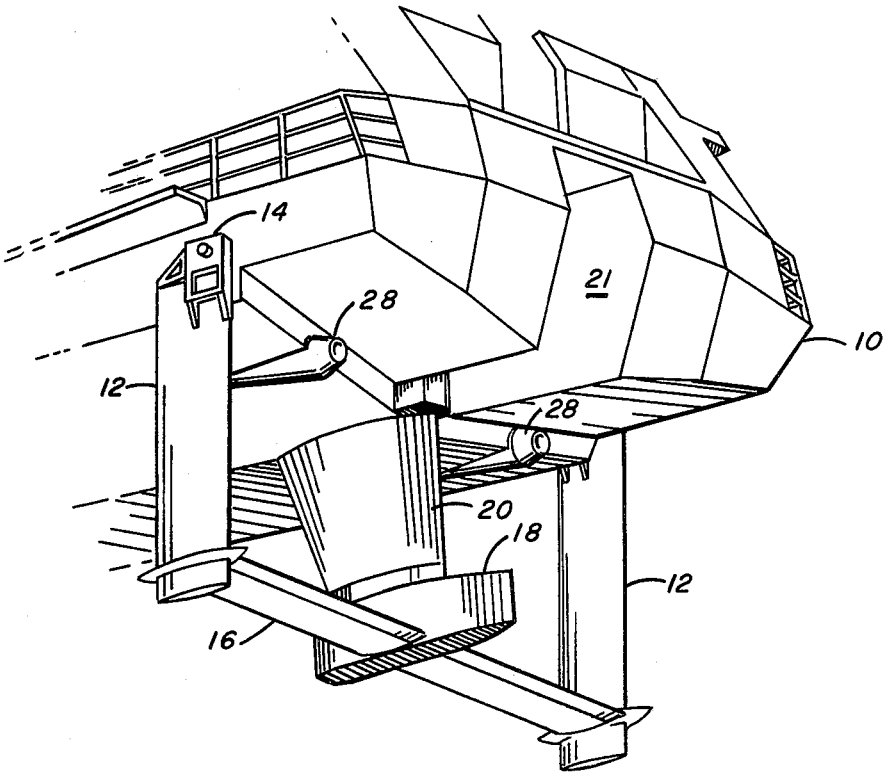
FIG. 1 is a perspective view of the stern portion of a hydrofoil craft having a water-jet propulsion system, looking in the forward direction.

As previously indicated, the invention relates to water-jet propulsion systems for watercraft and particularly for hydrofoil craft. While the protective system of this invention is applicable to any water-jet system for any type of watercraft, it is shown in connection with a propulsion system for hydrofoil craft of the type disclosed in Coffey et al U.S. Pat. No. 3,745,959 and Ashleman U.S. Pat. No. 3,918,256. As shown in FIG. 1, this system may be applied to a hydrofoil craft having a hull 10 of any suitable type or design with struts 12 pivotally mounted on the hull adjacent the aft end thereof at 14. The struts 12 are connected at their lower ends by a foil system 16 which may include control surfaces and which extends transversely of the craft as shown. The struts 12 are pivotally movable about the pivots 14 to a retracted or horizontal position when hullborne operation of the craft is desired. It will be understood that a similar strut is provided adjacent the bow of the craft and may be pivotal about a vertical axis for use as a rudder, if desired. Reference is made to the above-mentioned Coffey et al patent for a more complete description of the hydrofoil craft and foil system.

Figure 2:
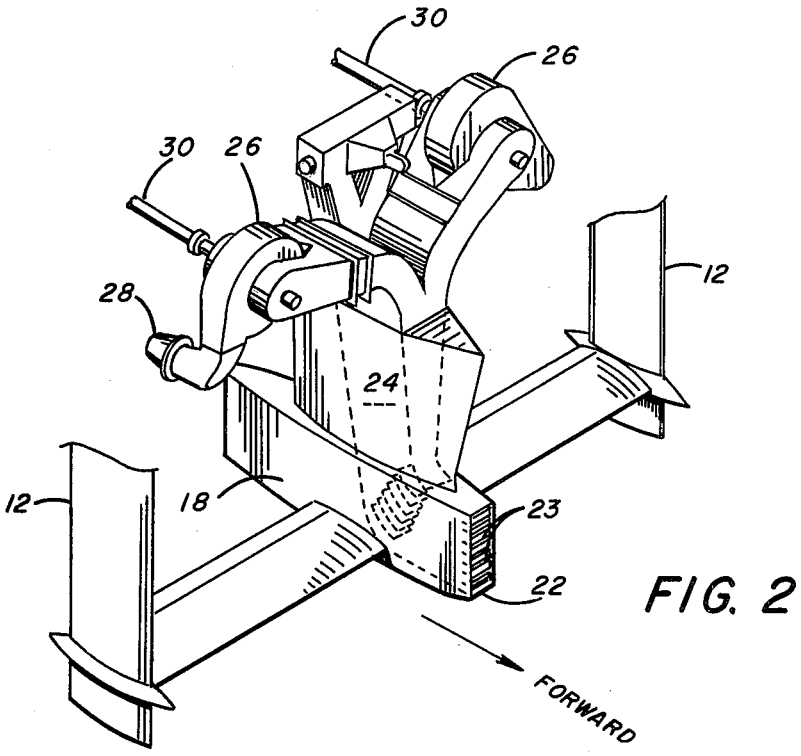
FIG. 2 is a somewhat diagrammatic perspective view, looking in the aft direction, showing the elements of a water-jet propulsion system.

A water intake structure 18 including a center column 20 is supported on the foil system 16, a slot 21 being provided in the hull 10 to receive the column 20 when the foils are retracted. Referring particularly to FIG. 2, it will be seen that the intake structure 18 has an intake port or opening 22 at its forward end which may have vanes 23 to direct the flow of water. Water entering through the port 22 flows through an inlet passage 24 in the column 20 and, in the illustrated embodiment, the inlet 24 is divided and directs the water to the entrances of two centrifugal pumps 26 which accelerate the water and discharge it rearwardly through jet nozzles 28. The resulting reaction force provides the forward propulsive force. The pumps 26 are driven through drive shafts 30 by a prime mover, or by individual prime movers, which may be of any suitable or desired type capable of driving the pumps at the desired speed. The prime mover may be controlled by any usual or desired type of throttle control either automatically or under the control of the pilot.

In normal operation, water is continuously drawn in through the intake port 22 and the inlet passage 24 under the ram pressure due to movement of the craft through the water, and is discharged in a jet to propel the craft as described above at a speed determined by the speed of the prime mover. In rough weather, however, and especially if relatively high waves are encountered, the intake port 22 may occasionally broach, or penetrate the surface of the water, so that it is above the surface and admits air to the pumps. When this occurs and the flow of water is interrupted or diminished, at least momentarily, the prime mover is unloaded or the load is greatly reduced. This condition, therefore, results in unloading of the prime mover, or in large load fluctuations, and causes the prime mover to overspeed. The effect of overspeed is to actuate the protective devices with which the prime mover is normally provided which shut down the prime mover to prevent damage to the system. When this occurs, the propulsive force is lost and the craft slows down below the speed at which foilbourne operation can be sustained. The result is that the craft settles to the water and operates in the hullborne mode, with resultant discomfort to the passengers especially in rough weather where this condition is most likely to occur. After such a shutdown, it normally requires at least several minutes to restart the prime mover and for the craft to accelerate to a sufficient speed to resume foilbourne operation. To prevent the occurrence of this situation, the present invention provides means for anticipating the occurrence of such an overspeed condition and setting the prime mover to idling speed until the condition has passed, thus avoiding a shutdown and maintaining some propulsive force to keep the craft up to speed for the short time until the prime mover can be reset to normal operating control.

As previously stated, in normal operation water enters the intake port 22 under the ram pressure resulting from the forward movement of the intake structure 18 through the water, and the intake 22 and inlet passage 24 are substantially filled with water flowing to the pumps under this pressure. If the intake 22 comes to the surface of the water, however, and penetrates the surface, due to the presence of high waves or other causes, the flow of water through the inlet 24 is greatly reduced as the intake port 22 penetrates the surface and comes out of the water, and the pressure in the inlet 24 drops to a relatively low value and remains substantially at this low pressure while the intake is at or above the water surface. When the intake port 22 falls below the water surface, water again flows into the inlet passage 24 and the water pressure builds up again quite rapidly. In accordance with the present invention, these changes in pressure and in rate of change of pressure are utilized to anticipate the occurrence of a possible unloading condition and to take the appropriate actions of setting the prime mover to idling speed and then resetting it to normal operation.

Figure 3:
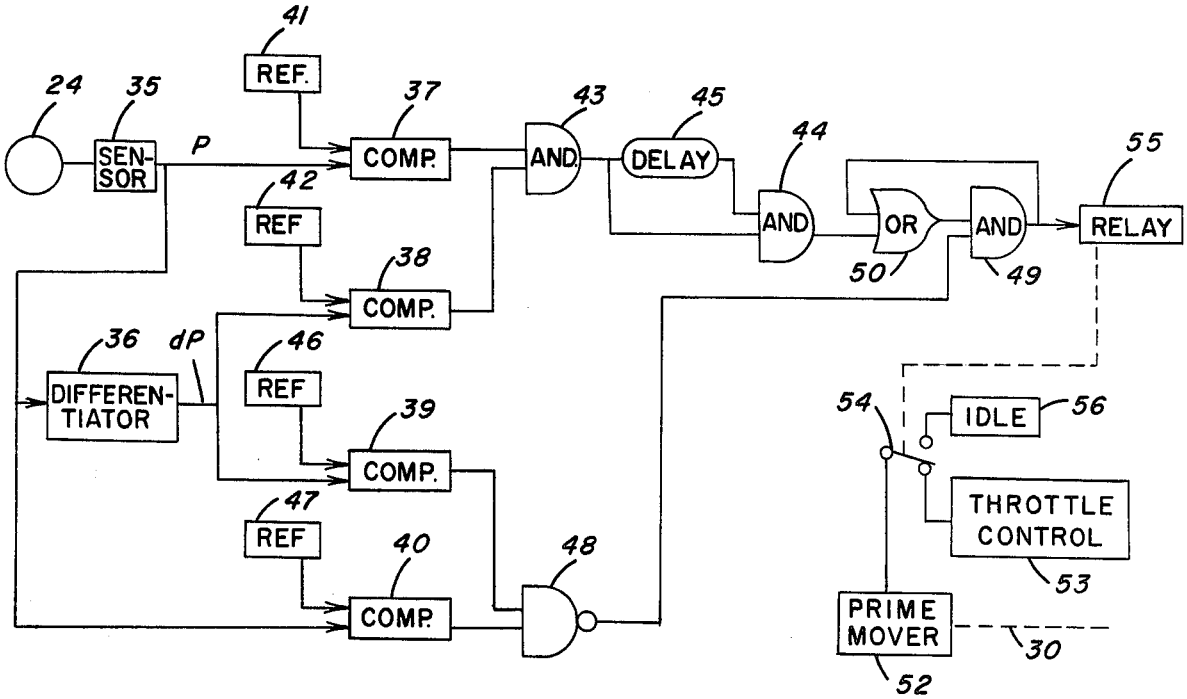
FIG. 3 is a logic diagram illustrating the operation of a protective system embodying the present invention.

The principle of operation of the invention is shown in FIG. 3 in the form of a logic diagram. As stated, the system operates in response to the changes of water pressure in the inlet passage 24 and, in general, the operation is to set the prime mover to idling speed when both the water pressure and the rate of change of pressure fall below preset levels for a preset time interval, and to reset the prime mover to normal operation when both pressure and rate of change of pressure exceed other preset levels.

A transducer or pressure sensor 35 may be used to sense the pressure in the inlet 24. The transducer 35 may be an electromechanical transducer of any suitable type, or any device capable of sensing the water pressure in the inlet 24 and providing an electrical output signal proportional to the pressure. The pressure signal P obtained from the transducer 35 is utilized directly and is also applied to a differentiator 36 which provides a rate signal dP proportional to the time derivative of the pressure signal, and thus proportional to the time rate of change of the water pressure in the inlet 24. The transducer 35 and differentiator 36, therefore, serve to generate signals proportional to the inlet water pressure and to the rate of change of the pressure, respectively.

These pressure and rate signals are compared to preset reference levels in a series of comparators 37, 38, 39 and 40, such as flip-flops, capable of comparing two inputs. The pressure signal P from transducer 35 is applied to comparator 37 which compares it to a pressure level established by a preset reference 41, and the rate signal dP from the differentiator 36 is applied to the comparator 38 where it is compared with a rate reference level established by a preset reference 42. The references 41 and 42 thus establish first reference levels which are preset at desired values to initiate operation of the system. In normal operation, the pressure and rate signals are well above these reference levels. If either of these signals falls below the corresponding reference level, however, an output signal occurs from the comparator 37 or 38. The output signals of the comparators 37 and 38 are applied to an AND gate 43 which produces an output only when signals are present from both of the comparators. The output of the AND gate 43 is applied to another AND gate 44, both directly and through a fixed time delay device 45, which introduces a time delay typically of the order of a few tenths of a second. Thus, the AND gate 44 has an output only when signals occur from both comparators 37 and 38 and are maintained for a time period at least equal to the time delay 45.

The rate signal dP is also applied to the comparator 39 and the pressure signal P is applied to the comparator 40. Preset reference levels 46 and 47 are established for each of these comparators, providing second reference levels which are different than the corresponding first reference levels 41 and 42. When the pressure and rate signals rise above the corresponding second reference levels, output signals occur from the respective comparators 39 and 40, and these signals are applied to a NAND gate 48. An output occurs from the NAND gate 48 only when no signal is received from either one or both of the comparators 39 and 40, and there is no output when signals are received from both comparators 39 and 40. The output of the gate 48 is applied to an AND gate 49. The output of the AND gate 44 is also applied through an OR gate 50 and the AND gate 49, and the output of the AND gate 49 is fed back to the OR gate 50 so that the AND gate 49 and the OR gate 50 constitute a latch. That is, if a signal from the gate 48 is present, and a signal from the AND gate 44 then occurs, it is transmitted through the OR gate 50 and since both inputs to the gate 49 are then present, an output signal occurs which is fed back through the OR gate 50 to the AND gate 49. As long as the signal from the gate 48 is present, therefore, the latch is maintained and an output signal occurs from the AND gate 49.

A prime mover 52 is shown which drives a pump through drive shaft 30. Where there are two jets as shown in FIGS. 1 and 2, a single prime mover may drive both pumps or separate prime movers may be used, each provided with a protective system as described. The prime mover 52 is normally operated in a conventional manner by a throttle control 53 under the control of a pilot, or of suitable automatic means, to drive the pump to propel the craft at the desired speed. In accordance with the invention, the throttle control 53 is connected to the prime mover 52 through a relay contact 54 which is normally in the position shown so that the the throttle commands are transmitted to the prime mover 52 to control its speed. When the relay 55 is actuated, however, the contact 54 moves to an upper position which disconnects the throttle control 53 and connects an idle command 56 to the prime mover 52. This results in immediately setting the speed of the prime mover to idling speed which is maintained as long as the relay 55 is energized. When the relay is deactuated or deenergized, the contact 54 returns to the position shown and the prime mover is reset to normal operating conditions as called for by the throttle control 53.

In operation, the inlet water pressure is sensed as described above, and pressure and rate signals are generated by the transducer 35 and the differentiator 36. In normal operation, the pressure in the inlet 24 is relatively high and the relay 55 is in its deenergized position shown in FIG. 3. If the intake port 22 approaches or penetrates the surface of the water, the pressure in the inlet 24 rapidly drops to a relatively low value and the rate of change of pressure drops and becomes negative. When the pressure signal drops below the level established by the reference 41, the comparator 37 produces an output signal, and when the rate signal drops below the level established by the reference 42, which may be a high negative value, the comparator 38 provides an output signal. When signals are present from both comparators 37 and 38, an output occurs from the AND gate 43 which is applied to the AND gate 44 directly and through the time delay 45. If both signals remain below the respective reference levels for the set time delay, both inputs to the AND gate 44 are present and it produces an output signal which passes through the OR gate 50 to the AND gate 49. At this time, the water pressure may be, and the rate of change of pressure is, well below the respective second reference levels 46 and 47, so that there is not a signal from both comparators 39 and 40 and an output exists from the NAND gate 48 to the gate 49. Since both inputs to the AND gate 49 are thus present, it produces an output signal which is applied to the relay 55 to actuate it and cause the contact 54 to operate to set the prime mover 52 to idle speed. Thus, when the pressure signal and rate of change signal both fall below the set values and remain there for the predetermined time interval, the prime mover is immediately set to idling speed so that it is protected from overspeeding and from being shut down as a result of unloading and overspeed.

As soon as an output signal appears from the AND gate 44, the relay 55 is actuated and because of the action of the latch 49–50, the relay remains actuated even though the output signal of the AND gate 44 may be interrupted. Thus, the prime mover 52 remains at idling speed until the pressure in the inlet 24 is again approaching normal conditions. This occurs when the intake port 22 is again submerged and water is entering the inlet in the normal way. The water pressure in the inlet then builds up quite rapidly, and both the pressure and rate of change quickly exceed the second reference levels set by the respective references 46 and 47. This results in output signals from the corresponding comparators 39 and 40 which are applied to the NAND gate 48, and when both of these signals are present, the output of this gate ceases. Interruption of this output signal removes one of the inputs from the AND gate 49 and its output is interrupted. The relay 55 is thus deenergized and the contact 54 returns to its normal position in which the prime mover 52 is reset to the normal operating condition. The operation shown in FIG. 3, therefore, is to set the prime mover 52 to idle speed when both the water pressure in the inlet 24 and the rate of change of the pressure fall below predetermined reference levels for a predetermined time, and to maintain this condition until the pressure and the rate of change exceed a second pair of preset reference levels. The prime mover is then immediately reset to normal operation.

The system of FIG. 3 may be embodied in any suitable apparatus capable of operating in the manner described. A typical embodiment is shown schematically in FIG. 4 for the purpose of illustration. As there shown, the water pressure in the inlet 24 is sensed by the transducer 35 which produces an electrical pressure signal P. The transducer 35 may be an electromechanical transducer of any suitable type connected to the inlet 24 at an appropriate point by any suitable means such as by small-diameter piping. The pressure signal P is applied to a differentiating amplifier 60 which may be an operational amplifier, or other suitable device, which generates a signal dP proportional to the time rate of change of the pressure signal. The pressure and rate signals thus generated are are applied to a series of comparators 61, 62, 63 and 64 which may be solid-state flip-flops or other devices capable of comparing two inputs. The various other components shown schamatically in FIG. 4 may be solid-state devices of known types, or they may be devices of any type capable of performing the functions described. The various preset reference levels corresponding to those described above are preferably set by means of a selector switch 65 which permits setting the system to different preselected combinations of reference levels in accordance with varying sea or weather conditions.

The pressure signal P from the transducer 35 is applied to comparator 61 and when the signal falls below the reference level, an output signal occurs which is applied to a timer 66 and to a reset timer 67. The rate signal dP is similarly applied to comparator 62 and when it falls below the reference level, a signal occurs from the comparator 62 which is also applied to the timers 66 and 67. The timer 66 may be of any suitable type which is started when both signals are present and produces an output after the lapse of a set time. The output of the timer 66 is applied to the timer 67. The length of the time period of the timer 66 may be adjustable and can be set by the selector switch 65 as indicated at 68. When output signals from both comparators 61 and 62 and an output signal from timer 66 are all applied to reset timer 67, an immediate signal occurs at 69 and is applied to a relay driver 70. The reset timer is simultaneously started and after a preset time interval, a signal appears at 71 and is applied to the relay driver 70 as a release signal. A hold circuit 72 is also provided which responds to the same three signals as the timer 67, that is, the signals from the comparators 61 and 62 and the signal from the timer 66. When all three signals are present, a Hold signal appears at 73 which is applied to the relay driver 70.

The rate signal dP and pressure signal P are also applied to the comparators 63 and 64, respectively, which control resetting of the prime mover to normal operation. When either the pressure signal or the rate signal exceeds the corresponding reference level, the respective comparator provides an output signal which is applied to a release circuit 74. When signals from both comparators 63 and 64 are present, a release signal appears at 75 which is applied to the Hold circuit 72.

The operation of this illustrative embodiment is essentially the same as that of FIG. 3. Thus, in normal operation, the inlet 24 is filled with water at relatively high pressure. When the intake port 22 broaches, or is about to broach, the water pressure drops rapidly and the rate of change is negative. When both the pressure and rate of change are below the respective reference levels, as set by the selector switch 65, output signals occur from both comparators 61 and 62 and the timer 66 is started in operation. At the end of the present time period, the output signal of the timer 66 is applied to reset timer 67, and if all three inputs to this timer are present, an output signal appears immediately at 69 which energizes the relay driver 70 to actuate the relay 55. The prime mover 52 is thus set to idling speed as previously described. The same three signals actuate the Hold circuit 72 to apply the Hold signal 73 to the relay driver. After the lapse of the present time interval, the timer 67 supplies a signal 71 to the relay driver which serves as a release signal. The Hold circuit maintains the signal 73 until it is released so that the relay 55 is held in its actuated position.

When the intake port 22 again becomes submerged, the pressure rapidly rises in the inlet 24 so that both pressure and rate signals increase and when they exceed the respective reference levels set by the switch 65, output signals occur from comparators 63 and 64. When both of these signals are present, the release circuit 74 provides a release signal at 75 which is applied to Hold circuit 72. This causes the Hold circuit to terminate the signal 73 and release the relay driver 70, and if the timer 67 has reached the end of its time period and the release signal 71 is present, the driver 70 is deenergized. The relay 55 is thus released and returns to its normal position in which the prime mover is reset to normal operation.

Figure 4:
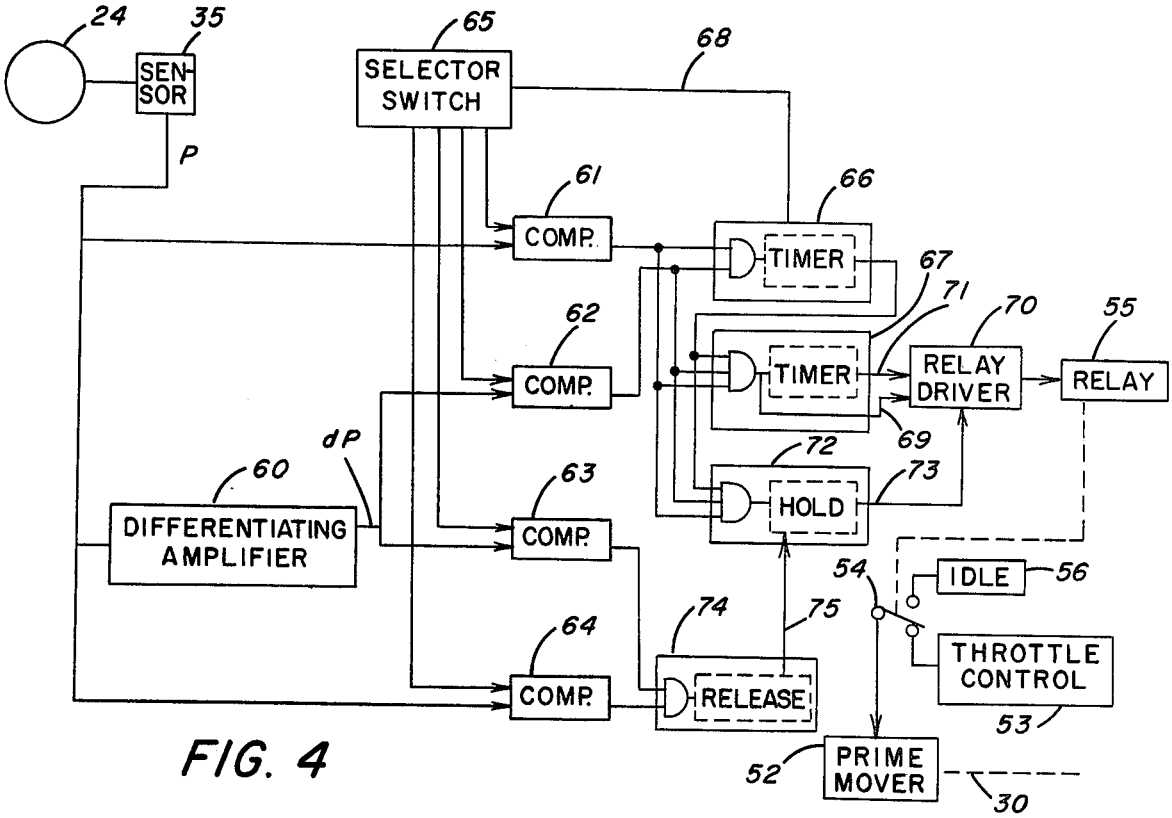
FIG. 4 is a schematic diagram showing an illustrative embodiment of the invention.

The actual values of the reference levels may vary with conditions. By way of illustration, however, in a typical embodiment as shown in FIG. 4, the reference level for comparator 61 may be 28 psi and for comparator 62 may be −13 psi/sec. When the pressure P and rate dP both fall below these respective values, the prime mover is set to idling condition if the pressure and rate signals remain below the reference levels for the time set by the timer 66 which may be 0.1 second. The pressure reference level for comparator 64 may be 15 psi and the rate reference level for comparator 63 may be set at zero. When these reference levels are exceeded, as the intake port submerges, the relay 55 is released and the prime mover is reset to normal operation if the time period of the timer 71 has elapsed. It has been found in actual practice, in hydrofoil application, that the increase of pressure in the inlet is so rapid that the timer 71 can be set to zero time delay, or entirely omitted from the system.

It will now be apparent that a protective control system has been provided for water-jet propulsion systems in which the prime mover is set to idle speed when the pressure and the rate of change of the pressure in the inlet pipe both fall below predetermined levels and remain below those levels for a predetermined time. This condition indicates that the intake port is about to broach, or has actually broken through the surface, and the prime mover is then set to idle speed to prevent unloading and overspeed with possible undesired shutdown of the prime mover. The prime mover is reset to normal operating condition as soon as the intake port is again submerged as indicated by a rapid build-up of pressure in the inlet. A very effective protective system is thus provided which effectively protects against unnecessary shutdowns of the prime mover of a water-jet propulsion system. The new system is relatively simply and highly reliable and may be conveniently made up of known and readily available solid-state devices.

We claim as our invention:

1. In a propulsion system for watercraft having an inlet for water, pump means for discharging said water in a jet to provide a propulsive force and a prime mover for driving the pump means, a control system for said prime mover including means for generating a pressure signal proportional to the water pressure in said inlet and a rate signal proportional to the rate of change of said water pressure, and means for setting said prime mover to idling speed when both of said signals fall below first predetermined reference levels and remain below said levels for a predetermined time.

2. A system as defined in claim 1 and including means for resetting the prime mover to normal operation when both of said signals exceed second predetermined reference levels.

3. A system as defined in claim 2 including first comparison means for comparing said pressure signal and said rate signal to the respective first reference levels, second comparison means for comparing the pressure signal and the rate signal to the respective second reference levels, relay means for effecting said setting of the prime mover to idling speed and for returning the prime mover to its normal operation, and means for deriving signals from said comparison means for controlling operation of said relay means.

4. A system as defined in claim 3 including means for deriving first output signals from said first comparison means when both pressure and rate signals are below the first reference levels, time delay means responsive to said output signals for providing a delayed signal, and means responsive to the simultaneous pressure of said first output signals and said delayed signal for actuating said relay means to effect setting of the prime mover to idling speed.

5. A system as defined in claim 4 including means for deriving second output signals from said second comparison means when both pressure and rate signals exceed the second reference levels, and means responsive to the simultaneous presence of said second output signals for deactivating the relay means to effect resetting of the prime mover for resumption of normal operation of the propulsion system.

6. A system as defined in claim 5 including means responsive to the presence of said first output signals and said delayed signal for holding the relay in actuated position, and means responsive to the simultaneous presence of said second output signals for releasing the relay means to return the relay means to its deactivated state.

7. A system as defined in claim 6 and including timing means responsive to said first output signal and said delayed signal for preventing release of the relay means for a predetermined time after actuation of the relay means.

* * * * *